US010348022B2

(12) United States Patent
Endo et al.

(10) Patent No.: US 10,348,022 B2
(45) Date of Patent: Jul. 9, 2019

(54) CONNECTOR ABLE TO SUPPRESS THE JERKING OF THE TERMINAL HOUSED IN THE TERMINAL HOUSING CHAMBER

(71) Applicant: Yazaki Corporation, Tokyo (JP)

(72) Inventors: Takuya Endo, Shizuoka (JP); Jun Goto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/997,680

(22) Filed: Jun. 4, 2018

(65) Prior Publication Data

US 2018/0358731 A1 Dec. 13, 2018

(30) Foreign Application Priority Data

Jun. 9, 2017 (JP) ..... 2017-114486

(51) Int. Cl.

| | |
|---|---|
| ***H01R 13/436*** | (2006.01) |
| ***H01R 13/52*** | (2006.01) |
| ***H01R 13/6581*** | (2011.01) |
| ***H01R 13/502*** | (2006.01) |
| ***H01R 13/50*** | (2006.01) |

(Continued)

(52) U.S. Cl.

CPC ..... *H01R 13/4361* (2013.01); *H01R 13/4226* (2013.01); *H01R 13/50* (2013.01); *H01R 13/502* (2013.01); *H01R 13/5202* (2013.01); *H01R 13/6581* (2013.01); *H01R 13/74* (2013.01); *H01R 13/62933* (2013.01); *H01R 2201/26* (2013.01)

(58) Field of Classification Search

CPC .. H01R 13/4361; H01R 13/50; H01R 13/502; H01R 13/5202; H01R 13/6581; H01R 13/74; H01R 13/62933; H01R 2201/26; H01R 13/10; H01R 13/4223; H01R 13/4226

USPC ..... 439/752, 682–691, 595, 845, 849, 850, 439/854, 855, 881, 902

See application file for complete search history.

(56) References Cited

U.S. PATENT DOCUMENTS 6,672,911 B2 * 1/2004 Zhao ..... H01R 11/22 439/271
6,837,745 B2 * 1/2005 Takada ..... H01R 13/562 439/521

(Continued)

FOREIGN PATENT DOCUMENTS

JP 2011-119120 A 6/2011

*Primary Examiner* — Travis S Chambers
(74) *Attorney, Agent, or Firm* — Kenealy Vaidya LLP

(57) ABSTRACT

A connector includes a terminal, and a housing having a housing chamber for housing the terminal. The terminal includes a wire connection portion and an electric contact portion. An axial direction of the electric contact portion is a front-back direction crossing a vertical direction along which the wire connection portion and the electric contact portion are arranged in a row. The electric contact portion is formed in a tubular shape with a first wall portion continuing to the wire connection portion, a second wall portion facing the first wall portion, a third wall portion interposed between the first and second wall portions, and a fourth wall portion in the wire connection side and facing the third wall portion. The housing includes a locking arm. A claw portion of the locking arm catches a border portion between the second the fourth wall portions.

3 Claims, 12 Drawing Sheets

(51) Int. Cl.

| | |
|---|---|
| ***H01R 13/74*** | (2006.01) |
| ***H01R 13/422*** | (2006.01) |
| *H01R 13/629* | (2006.01) |

(56) References Cited

U.S. PATENT DOCUMENTS

| | | | | |
|---|---|---|---|---|
| 7,458,863 | B2 * | 12/2008 | Shimizu | H01R 13/4223 439/839 |
| 7,462,080 | B2 * | 12/2008 | Shiraishi | H01R 13/113 439/852 |
| 7,670,177 | B2 * | 3/2010 | Myer | H01R 13/4365 439/595 |
| 8,872,024 | B2 * | 10/2014 | Miyakawa | B29C 45/4407 174/520 |
| 2012/0100753 | A1 | 4/2012 | Omae et al. | |
| 2018/0090873 | A1 * | 3/2018 | Masuda | H01R 4/70 |

* cited by examiner

CONNECTOR ABLE TO SUPPRESS THE JERKING OF THE TERMINAL HOUSED IN THE TERMINAL HOUSING CHAMBER

BACKGROUND

Technical Field

The present invention relates to a connector.

Background Art

Various electronic components are mounted on a vehicle, and a wiring harness is arranged in the vehicle for supplying electric power and control signals to the electronic components. The wiring harness includes a plurality of electric wires and a connector. By fitting this connector with a connector of the electronic component or a connector of the other wiring harness, the electric wires are connected to the electronic components or the other wiring harness.

As a connector to be used in such a wiring harness, an L-shaped connector attached to terminals of two shield cables handling high voltage of an electric vehicle (EV) or a hybrid electric vehicle (HEV) is known (for example, refer to Patent Literature 1). FIG. 12 is an exploded perspective view showing a conventional L-shaped connector. FIG. 13 is a sectional view showing the conventional L-shaped connector of FIG. 12 in an assembled state.

As shown in FIGS. 12 and 13, a conventional L-shaped connector 101 disclosed in the Patent Literature 1 includes a split-type L-shaped inner housing 103 for housing an L-shaped terminal 102 (shown in FIG. 13), a shield shell 106 made of conductive metal and covering a horizontal tubular portion 104 of the inner housing 103, an aluminum housing 107 made of conductive metal for housing a vertical rectangular tubular portion 103A of the inner housing 103, a circular rubber shield packing 108 for waterproofing a space between the shield shell 106 and the aluminum housing 107, an outer housing 109 made of insulating resin for covering the shield shell 106, and a circular rubber housing packing 110 for waterproofing a space between the shield shell 106 and the outer housing 109.

CITATION LIST

Patent Literature

Patent Literature 1: JP 2011-119120 A

SUMMARY

Technical Problem

In such a conventional connector 101, it is necessary to form the split-type L-shaped inner housing 103 for housing the L-shaped terminal 102, and a structure of the inner housing 103 is complex. Therefore, it can be considered to make a shape of the L-shaped terminal 102 (female terminal) such a shape that a mating terminal is inserted in a direction perpendicular to a shaft of an electric wire (namely, I-shape), and thereby a structure of the inner housing for housing the female terminal becomes simple.

In this case, by inserting the female terminal in the shaft direction of the electric wire, the female terminal is housed in a terminal housing chamber formed in the inner housing. When tried to retain the female terminal in the terminal housing chamber by fitting a lance beak projecting from an inner wall of the terminal housing chamber into a lance hole formed on a female terminal for housing the lance beak, it is necessary to ensure a clearance between the terminal housing chamber and the female terminal in a projecting direction of the lance beak, and there is a fear that the terminal housed in the terminal housing chamber may jerk.

An object of the present disclosure is to provide a connector able to suppress the jerking of the terminal housed in the terminal housing chamber.

Solution to Problem

For solving the above problem, a connector according to a first aspect of the present disclosure includes: a terminal to which an electric wire is connected; and a housing having a housing chamber for housing the terminal, wherein the terminal includes a wire connection portion, and an electric contact portion arranged in a row with the wire connection portion and formed in a tubular shape of which inner periphery contacts a mating terminal, wherein an axial direction of the electric contact portion crosses a direction along which the wire connection portion and the electric contact portion are arranged in a row wherein electric contact portion is formed in a tubular shape with a first wall portion continuing to the wire connection portion, a second wall portion facing the first wall portion, a third wall portion interposed between the first and second wall portions, and a fourth wall portion in the wire connection portion side and facing the third wall portion, wherein the housing includes a locking arm composed of an arm of which a base end is fixed to an inner face of the housing chamber, said arm extending along a facing direction of the third and fourth wall portions, and a claw portion provided on a free end of the arm, and wherein the claw portion catches a border portion between the second and the fourth wall portions.

According to a second aspect of the present disclosure as described in the first aspect, a hook portion to be hooked on the claw portion is formed on the border portion.

According to a third aspect of the present disclosure as described in the second aspect, the hook portion is cut and raised toward the claw portion.

Advantageous Effects of Invention

According to the first aspect of the present disclosure, because the claw portion catches a border portion between the second and the fourth wall portions, there becomes unnecessary to ensure the clearance between the terminal housing chamber and the terminal for moving beyond the lance beak as the prior art. Namely, because there becomes unnecessary to ensure the clearance (a gap) between the terminal housing chamber and the terminal, and the gap between the terminal housing chamber and the terminal can be reduced, and the jerking of the terminal housed in the terminal housing chamber can be suppressed.

DETAILED DESCRIPTION

Figure 1:
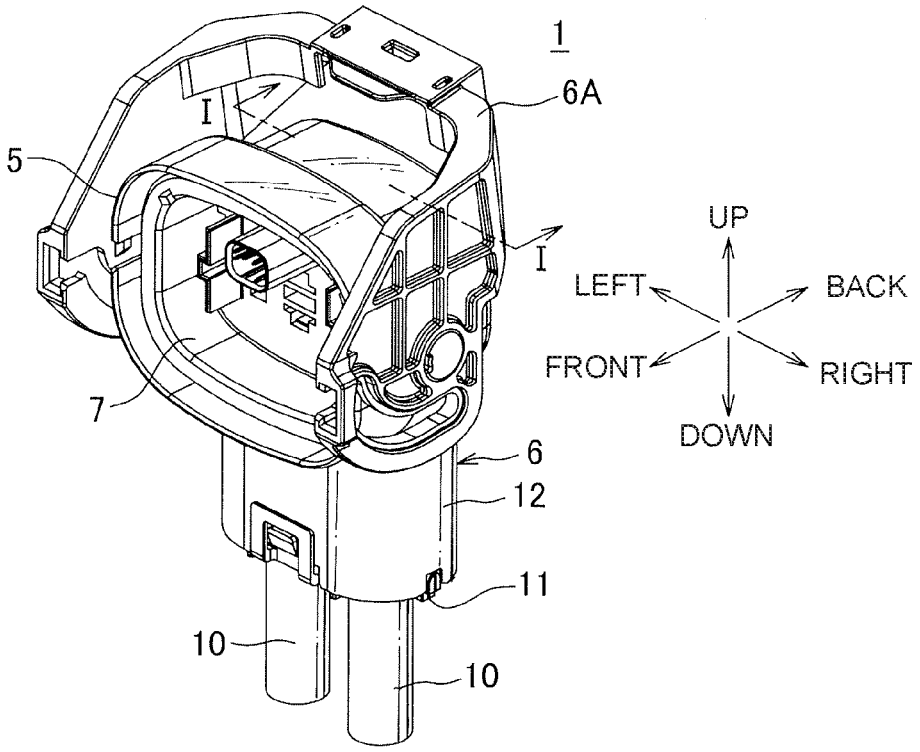
FIG. 1 is a perspective view showing a connector according to an embodiment of the present disclosure.
Figure 2:
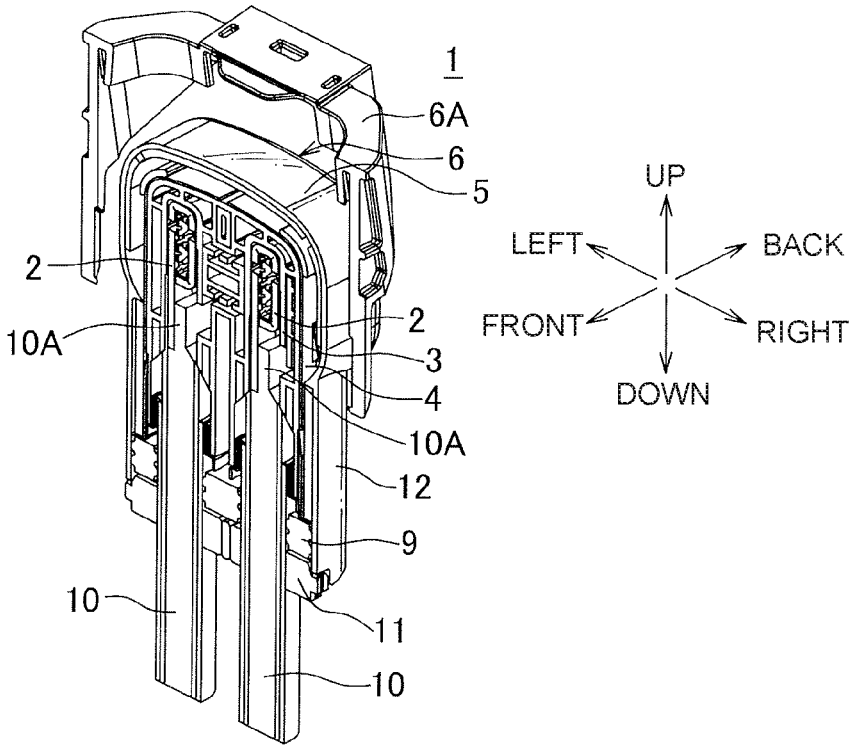
FIG. 2 is a sectional perspective view taken on line I-I in FIG. 1.
Figure 3:
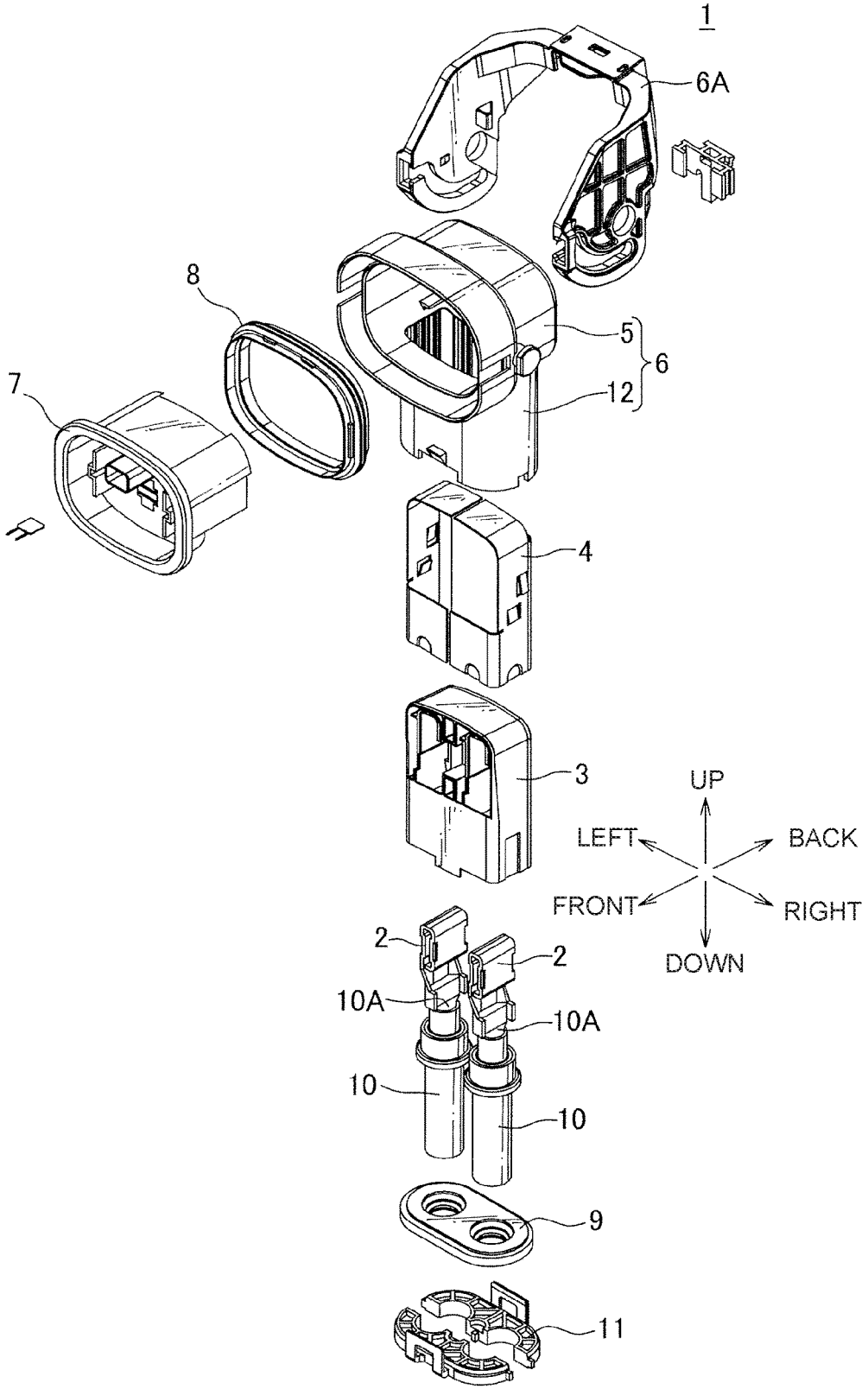
FIG. 3 is an exploded perspective view of the connector.

Hereinafter, an embodiment of the present disclosure will be described with reference to figures. FIG. 1 is a perspective view showing a shield connector 1 (connector) according to an embodiment of the present disclosure. FIG. 2 is a sectional perspective view taken on line I-I in FIG. 1. FIG. 3 is an exploded perspective view of the shield connector 1.

As shown in FIGS. 1 to 3, the connector 1 includes: a pair of female terminals 2, 2 connected to a pair of shield electric wires 10, 10 (terminal, shown in FIGS. 2 and 3); an inner housing 3 (shown in FIGS. 2 and 3); a shield shell 4 (shown in FIGS. 2 and 3); and an outer housing 6 having a hood portion 5 fitted with a mating connector (not shown). Hereinafter, the connector 1 and the mating connector are sometimes described as "female connector 1" and "male connector" respectively.

Incidentally, in this embodiment, a fitting direction of the female connector 1 with the male connector is described as "a front-back direction" or "a shaft direction". An extension direction of the pair of shield electric wires 10, 10 is described as "an up-down direction". Further, a direction perpendicular to both "the front-back direction" and "the up-down direction" is sometimes described as "a left-right direction". Further, in "the front-back direction", when seeing from the female connector 1, the male connector side is described as "a front side", and a side away from the male connector is described as "a back side".

Further, as shown in FIG. 3, the female connector 1 includes: a front holder 7 attached to a hood portion 5 for fitting with the male connector; a circular packing 8 for ensuring watertight property of a fitting portion of the male connector and the female connector 1; a mat seal 9 attached to the shield electric wires 10, 10; and a rear holder 11 for supporting the mat seal 9.

Further, as shown in FIGS. 1 to 3, in the female connector 1, a lever 6A is supported rotatably by the outer housing 6. In a state that the connector housing of the male connector approaches the front holder 7 of the female connector 1, when the lever 6A is rotated, the male connector and the female connector 1 is fitted together or released from each other with a low operating force.

Figure 4:
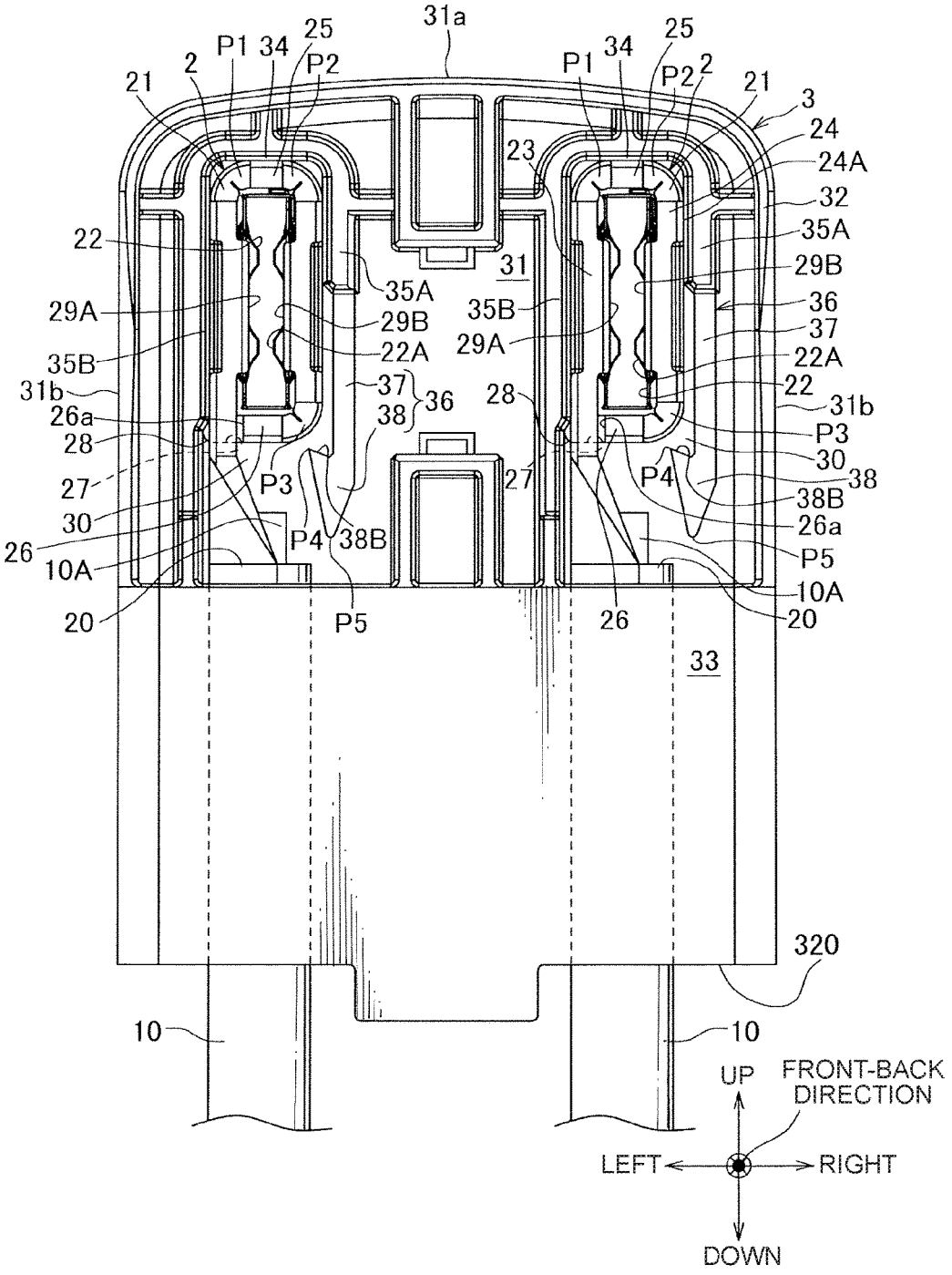
FIG. 4 is a plan view showing a state that a terminal shown in FIG. 3 is housed in an inner housing.

As shown in FIGS. 3 and 4, the inner housing 3 houses the female terminals 2, 2. The shield shell 4 (shown in FIG. 3) is formed in a shape able to cover the inner housing 3. The outer housing 6 includes: the hood portion 5; and a tubular portion 12 for guiding out the other terminals of the shield electric wires 10, 10.

Figure 5A:
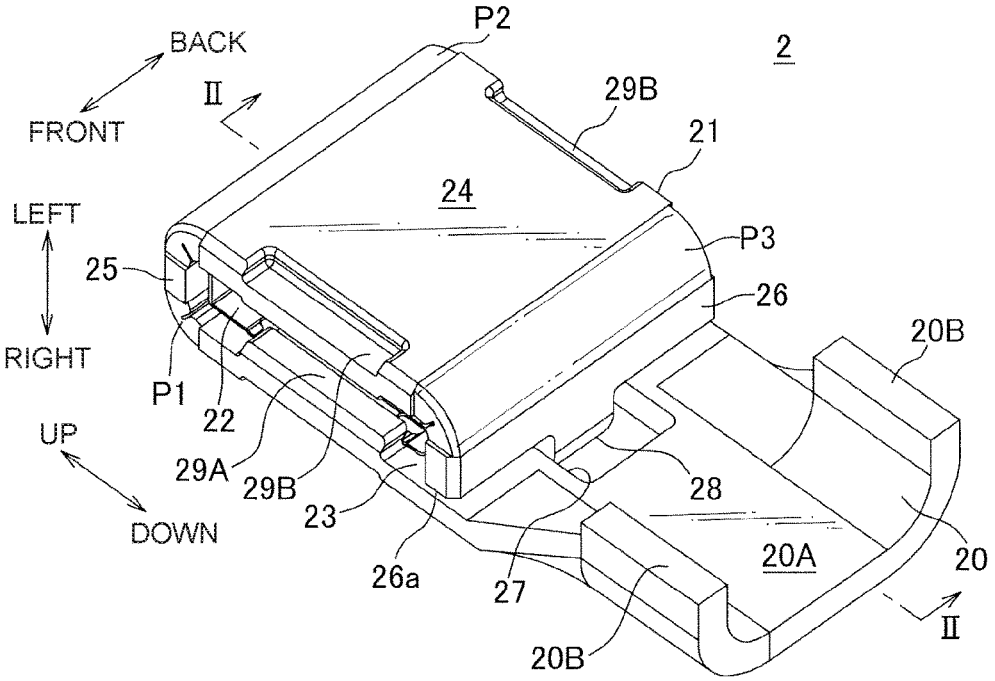
FIG. 5A is a perspective view of the terminal shown in FIG. 3.
Figure 5B:
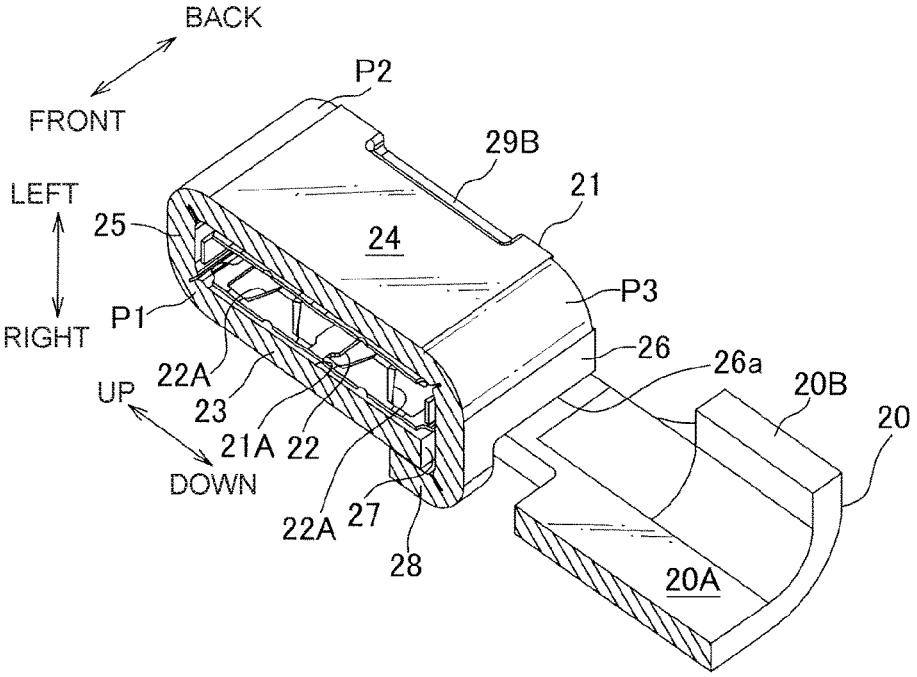
FIG. 5B is a sectional perspective view taken on line II-II of FIG. 5A.

As shown in FIGS. 5A and 5B, the female terminal 2 includes: a wire connection portion 20 connected to a core wire 10A of the shield electric wire 10; a rectangular tubular electric contact portion 21 into which a mate terminal (mating terminal) of the male connector is inserted and connected; and a conductive contact-reinforcing member 22 provided between the electric contact portion 21 and the male terminal.

The wire connection portion 20 is configured to include a rectangular substrate 20A on which the core wire 10A of the shield electric wire 10 is mounted, and a pair of caulking pieces 20B, 20B extending vertically from both ends in a width direction of the substrate 20A. The substrate 20A is arranged such that a long side direction is the up-down direction. Then, the wire connection portion 20 is connected to the shield electric wire 10 such that the shaft direction of the shield electric wire 10 is the up-down direction.

As shown in FIGS. 5A and 5B, the electric contact portion 21 includes: a first wall portion 23 continuing to an upper side of the substrate 20A of the wire connection portion 20; a second wall portion 24 facing the first wall portion 23 in the left-right direction; a third wall portion 25 interposed between the first wall portion 23 and the second wall portion 24, and a fourth wall portion 26 facing the third wall portion 25 in the up-down direction. Namely, the electric contact portion 21 is formed in a substantially rectangular tube shape of which an axial direction is the front-back direction. The third wall portion 25 is interposed between the first wall portion 23 and the second wall portion 24, and both ends in the left-right direction thereof respectively continue to both the first wall portion 23 and the second wall portion 24.

Further, the first wall portion 23, the second wall portion 24, the third wall portion 25, and the fourth wall portion 26 are obtained by bending a single metal plate. Namely, the electric contact portion 21 is obtained by respectively bending a border position P1 between the first wall portion 23 and the third wall portion 25, a border position P2 between the second wall portion 24 and the third wall portion 25, and a border position P3 between the second wall portion 24 and the fourth wall portion 26.

Further, in this embodiment, a through hole 27 is formed between the first wall portion 23 of the electric contact portion 21 and the substrate 20A of the wire connection portion 20. Further, the fourth wall portion 26 is provided with a locking piece 28 extending from an edge 26*a* away from the second wall portion 24, and caught by a peripheral edge of the through hole 27. The locking piece 28 is inserted into the through hole 27, and then bent, thereby the locking piece 28 is caught by the peripheral edge of the through hole 27. The catch of the locking piece 28 in the through hole 27 prevents the fourth wall portion 26 from separating from the first wall portion 23.

Further, as shown in FIG. 5A, a plurality of positioning projections 29A, 29B (for example, four in FIG. 5A) is formed on the electric contact portion 21 for positioning the inserted male terminal. Two of four positioning projections 29A, 29B are formed on each of the first wall portion 23 and the second wall portion 24. Further, one of four positioning projections 29A, 29B is provided on each of both ends in the front-back direction of the wall portions 23, 24, and faces each other in the left-right direction. Then, when the male terminal is inserted into, by inserting the male terminal into between the positioning projections 29A, 29B, the male terminal is positioned in place and the electric connection reliability between the electric contact portion 21 and the male terminal is ensured.

As shown in FIG. 5B, the contact-reinforcing member 22 is configured to include a spring piece 22A, and fixed to an inner face 21A of the electric contact portion 21. When the male terminal is inserted into the electric contact portion 21, the spring piece 22A elastically contacts the male terminal and thereby, the electric connection reliability between the electric contact portion 21 and the male terminal is improved.

The male terminal of the male connector is inserted and connected to the electric contact portion 21 among the first wall portion 23, the second wall portion 24, the third wall portion, and the fourth wall portion 26 in the front-back direction (axial direction). Namely, the front-back direction (axial direction) of the electric contact portion 21 is perpendicular to a direction that the wire connection portion 20 and the electric contact portion 21 continue to each other (up-down direction). Further, the electric contact portion 21 is inserted upward into a later-described terminal housing chamber 30 of the inner housing 3 from the third wall portion 25 side, and a corner portion (denoted by P3) positioned at the border position (border portion) P3 between the third wall portion 25 and the fourth wall portion 26 is caught by a later-described claw portion 38 of the terminal housing chamber 30.

Figure 6:
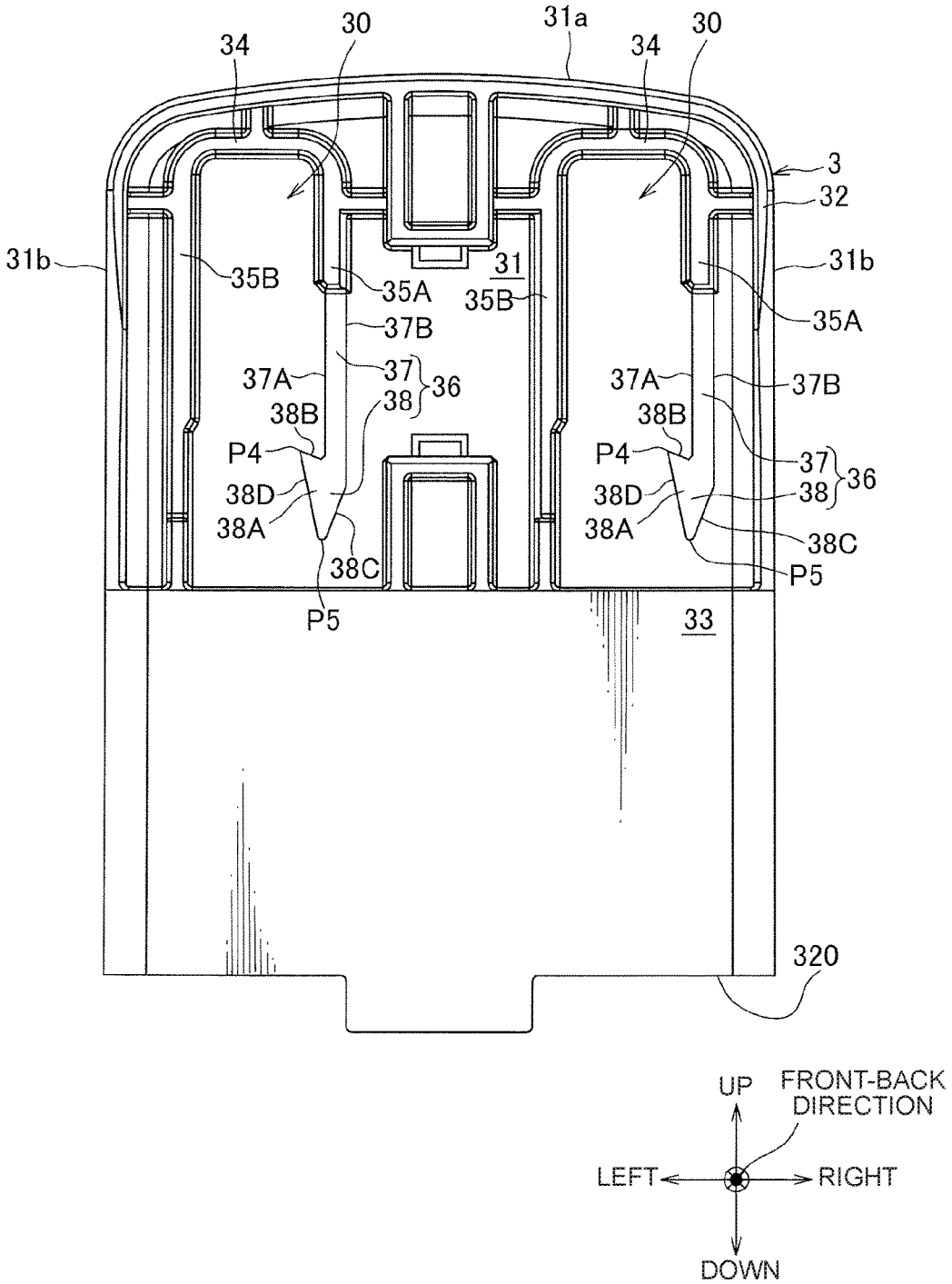
FIG. 6 is a plan view of the inner housing shown in FIG. 3.

As shown in FIG. 6, the inner housing 3 includes: a rectangular-plate-shaped housing substrate 31; a peripheral plate 32 extending vertically from a peripheral edge of the housing substrate 31; and a cover 33.

The housing substrate 31 is provided such that a long side direction thereof is the up-down direction, and a short side direction thereof is the left-right direction. The peripheral plate 32 is formed to extend vertically and forwardly from the upper side 31*a*, and long sides 31*b*, 31*b* of the housing substrate 31, and includes an opening 320 at a downward side thereof. The cover 33 is provided to face the housing substrate and in a size such that a lower part of a front opening of the inner housing is partially covered.

Further, a plurality of (two in an example shown in Figures) terminal housing chambers 30 are provided in the inner housing 3. Two terminal housing chambers 30 are arranged side by side in the left-right direction.

Figure 7A:
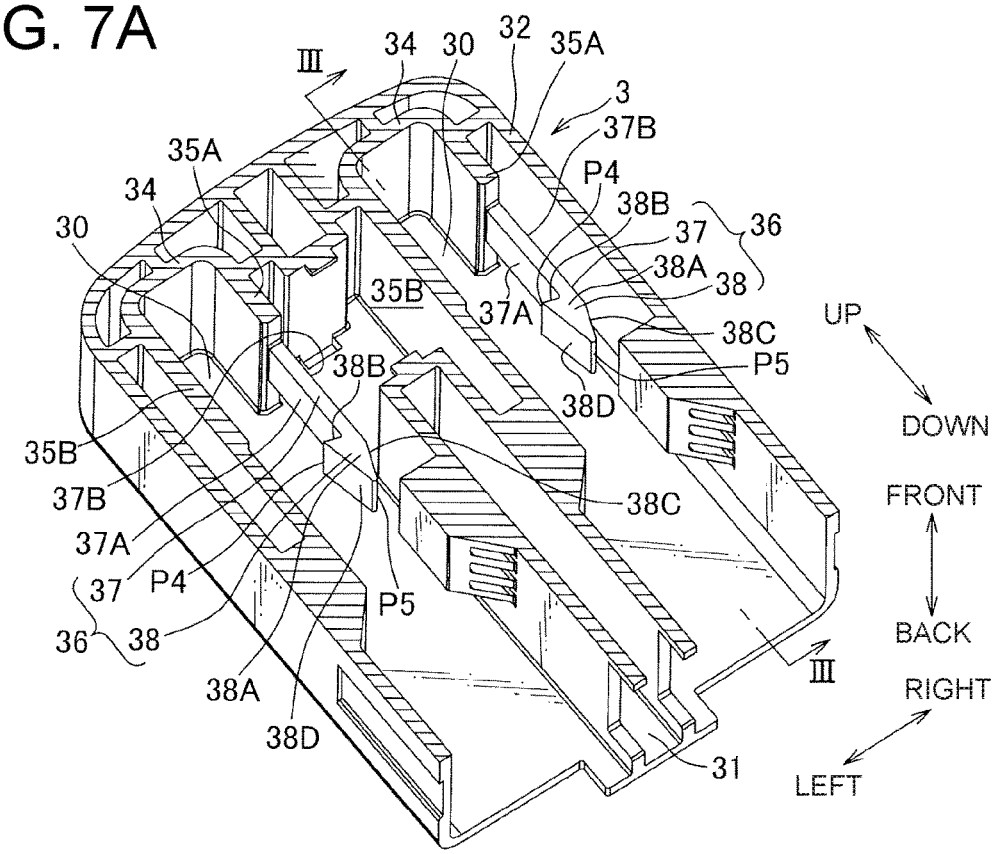
FIG. 7A is a perspective view of the inner housing shown in FIG. 6.
Figure 7B:
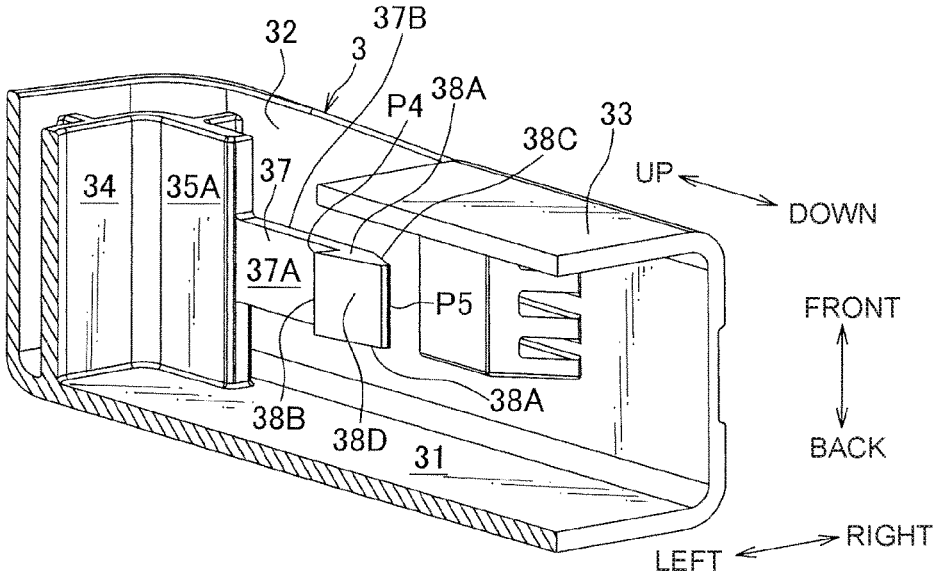
FIG. 7B is a sectional perspective view taken on line III-III of FIG. 7A.

As shown in FIGS. 6, 7A, and 7B, each terminal housing chamber 30 includes: an upper wall 34; a pair of wide walls 35A, 35B extending downward from each of left and right ends of the upper wall 34, and a locking arm 36 provided on a lower end of one of the pair of side walls 35A, 35B (hereinafter, referred to as one side wall 35A). Each terminal housing chamber 30 opens downward. A size between the pair of side walls 35A, 35B in the left-right direction is substantially same as a size of the electric contact portion 21 of the female terminal 2 in the left-right direction. A not-shown U-shaped groove is formed on the other of the pair of side walls 35A, 35B (hereinafter, referred to as the other side wall 35B) for receiving the locking piece 28 of the female terminal 2. In FIG. 7A, the cover 33 is omitted.

As shown in FIGS. 4, 6, 7A, and 7B, the locking arm 36 includes: an arm 37 extending in the up-down direction; and a claw portion 38 provided on a lower end of the arm 37 to catch the corner portion P3 (shown in FIG. 4) of the female terminal 2.

As shown in FIGS. 6, 7A, and 7B, the arm 37 is provided in a rectangular plate shape in a plan view, a long side direction is the up-down direction, a short side direction is the front-rear direction, and a thickness direction is the left-right direction. An upper end (base end) of this arm 37 continues to the lower end of the one side wall 35A, and a lower end (tip end) of the arm 37 is a free end. Such an arm 37 is elastically deformable in the left-right direction when external force is applied. Incidentally, hereinafter, a face of the arm 37 at the female terminal 2 side is referred to as "inner face 37A", and a face of the arm 37 away from the female terminal 2 is referred to as "outer face 37B".

As shown in FIGS. 7A and 7B, the claw portion 38 includes: a triangular facing face 38A facing in the front-rear direction; a first inclined face 38B continuing to the inner face 37A of the arm 37; a second inclined face 38*c* continuing to the outer face 37B of the arm 37; and a third inclined face 38D positioned between the first inclined face 38B and the second inclined face 38C. The first inclined face 38B is inclined upward as moving toward the female terminal 2 (left direction). A border portion between the first inclined face 38B and the third inclined face 38D is positioned on a tip end (denoted by P4) of the claw portion 38. A border portion P5 between the second inclined face 38*c* and the third inclined face 38D is positioned on a lower end (denoted by P5) of the claw portion 38.

In a state that such a claw portion 38 catches the corner portion P3 of the electric contact portion 21, as shown in FIG. 4, an intermediate portion of the first inclined face 38B positioned at an extension of an outer face 24A of the second wall portion 24 of the electric contact portion 21, and the tip end P4 of the claw portion 38 is positioned slightly downward from an outer face 26A (lower face) of the fourth wall portion 26 of the electric contact portion 21.

A procedure of the locking arm 36 of the terminal housing chamber 30 catching this electric contact portion 21 of the female terminal 2 will be described with reference to FIGS. 8A to 8C.

Figure 8A:
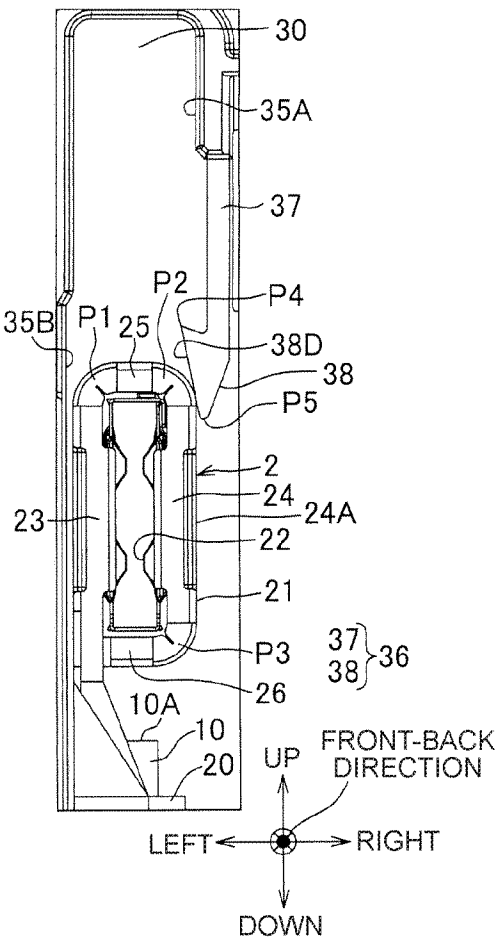
FIG. 8A is a plan view showing a condition that the terminal is to be caught by a locking arm of the inner housing.

First in the electric contact portion 21, as shown in FIG. 8A, while the first wall portion 23 is opposite to the other side wall 35B and the second wall portion 24 is opposite to the one side wall 35A, the third wall portion 35 is moved close to a lower opening of the terminal housing chamber 30, and inserted upward. Then, the corner portion P3 of the female terminal 2 abuts on the third inclined face 38D of the claw portion 38 of the locking arm 36.

Figure 8B:
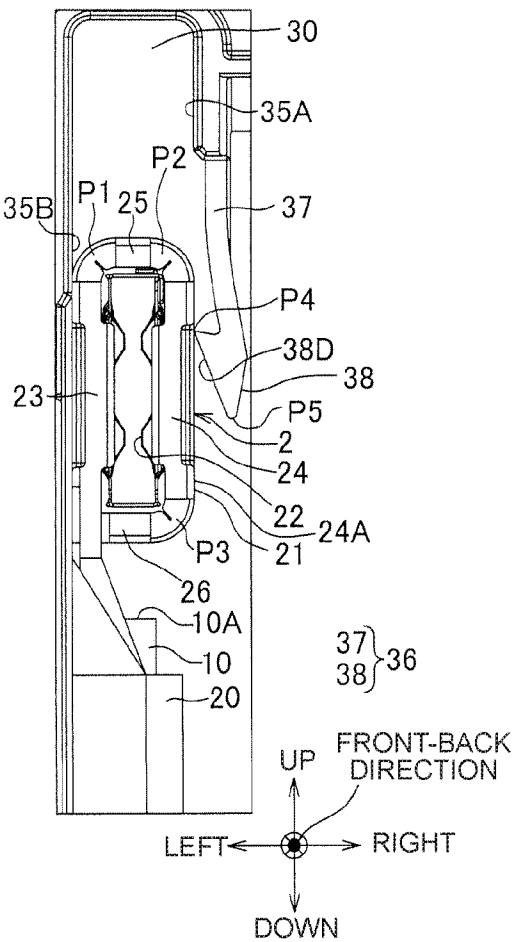
FIG. 8B is an explanatory view for explaining a next operation of FIG. 8A.

As the electric contact portion 21 is further moved upward, as shown in FIG. 8B, the electric contact portion 21 is moved relative to the third inclined face 38D, and the third inclined face 38D is pushed by the electric contact portion 21. Then, while the arm 37 is bent in a direction away from the electric contact portion 21, the tip end P4 of the claw portion 38 abuts on the outer face 24A of the second wall portion 24.

Figure 8C:
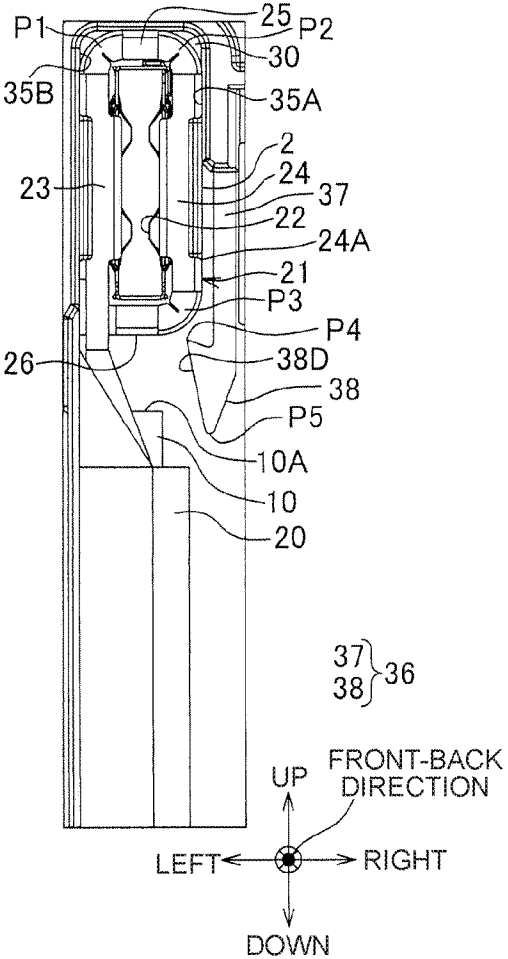
FIG. 8C is a plan view showing a state that the terminal is caught by the locking arm of the inner housing.

As the electric contact portion 21 is moved upward, as shown in FIG. 8C, the electric contact portion 21 is moved relative to the tip end P4 of the claw portion 38, an intermediate portion in the left-right direction of the first inclined face 38B is positioned at an extension of the outer face 24A of the second wall portion 24 of the electric contact portion 21, and the tip end P4 of the claw portion 38 is positioned slightly downward from the outer face 26A (lower face) of the fourth wall portion 26 of the electric contact portion 21. In this way, the locking arm 36 catches the corner portion P3 of the electric contact portion 21.

According to the embodiment described above, because the claw portion 38 catches the corner portion P3 (the border portion between the second wall portion 24 and the fourth wall portion 26) of the electric contact portion 21, there is no need to secure a clearance (gap) between the terminal housing chamber 30 and the female terminal 2, and a gap between the terminal housing chamber 30 and the female terminal 2 can be reduced. Therefore, the jerking of the female terminal 2 housed in the terminal housing chamber 30 can be suppressed.

When tried to retain the female terminal in the terminal housing chamber by fitting a lance beak projecting from an inner wall of the terminal housing chamber into a lance hole formed on the female terminal for housing the lance beak, a large insertion force is needed when the female terminal is moved over and moved beyond the lance beak. In this embodiment, when the claw portion 38 catches the corner portion P3 of the electric contact portion 21, the female terminal 2 is retained in the terminal housing chamber 30. Therefore, a large force (insertion force) is unnecessary. Accordingly, a burden of an operator who assembles the connector 1 can be reduced.

Incidentally, the present invention is not limited to the embodiment described above, includes other compositions for achieving the object of the present invention, and includes modifications as follows.

Figure 9A:
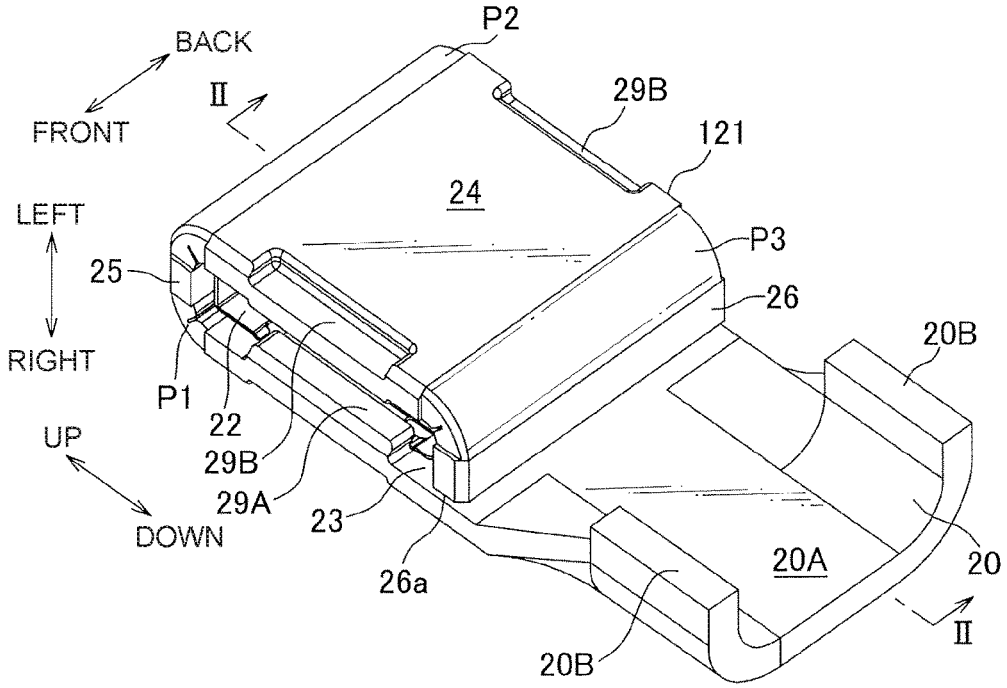
FIG. 9A is a perspective view of a variation of the terminal shown in FIG. 3.
Figure 9B:
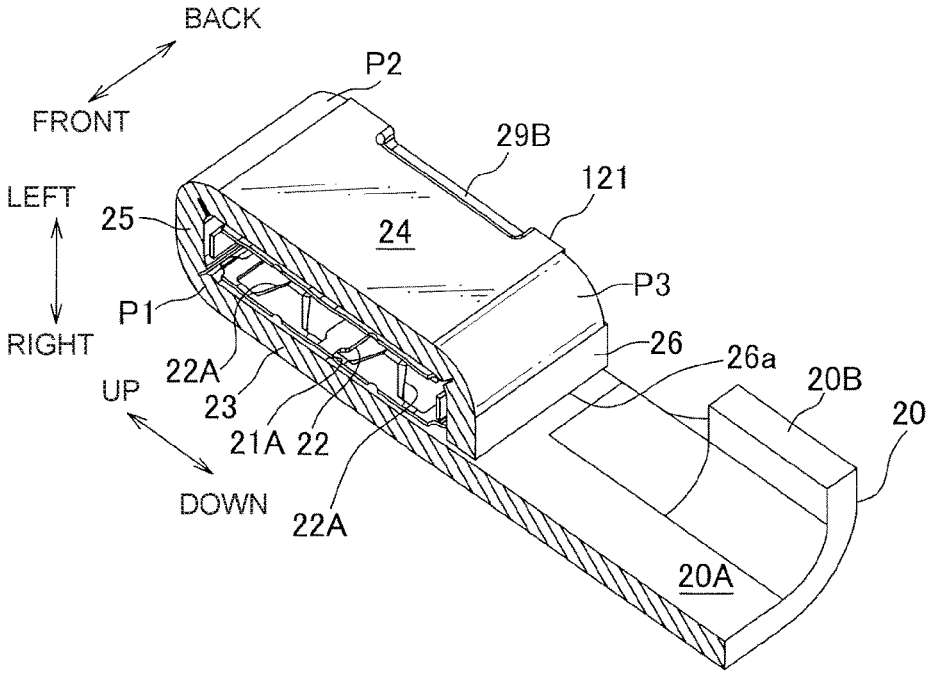
FIG. 9B is a sectional perspective view taken on line IV-IV of FIG. 9A.

In the embodiment above, the fourth wall portion 26 composing the electric contact portion 21 is provided with the locking piece 28 extending from an edge 26*a* away from the second wall portion 24, and caught by a peripheral edge of the through hole 27. However, the present invention is not limited to this. Although there is a fear that the fourth wall portion 26 is separated from the first wall portion 23, as shown in FIGS. 9A and 9B, the electric contact portion 121 may not be provided with the locking piece 28. In this case, the through hole 27 formed between the first wall portion 23 and the substrate 20A of the wire connection portion 20 for catching the locking piece 28 may be omitted. Namely, the first wall portion 23 and the fourth wall portion 26 may not belong to a fixation relationship. Further, in this embodiment, the fourth wall portion 26 does not contact the first wall portion 23, however, the fourth wall portion 26 may contact the first wall portion 23. In this way, both of a case that the fourth wall portion 26 contacts the first wall portion 23, and the case that the fourth wall portion 26 does not contact the first wall portion 23 are included in the scope of the present invention.

Figure 10A:
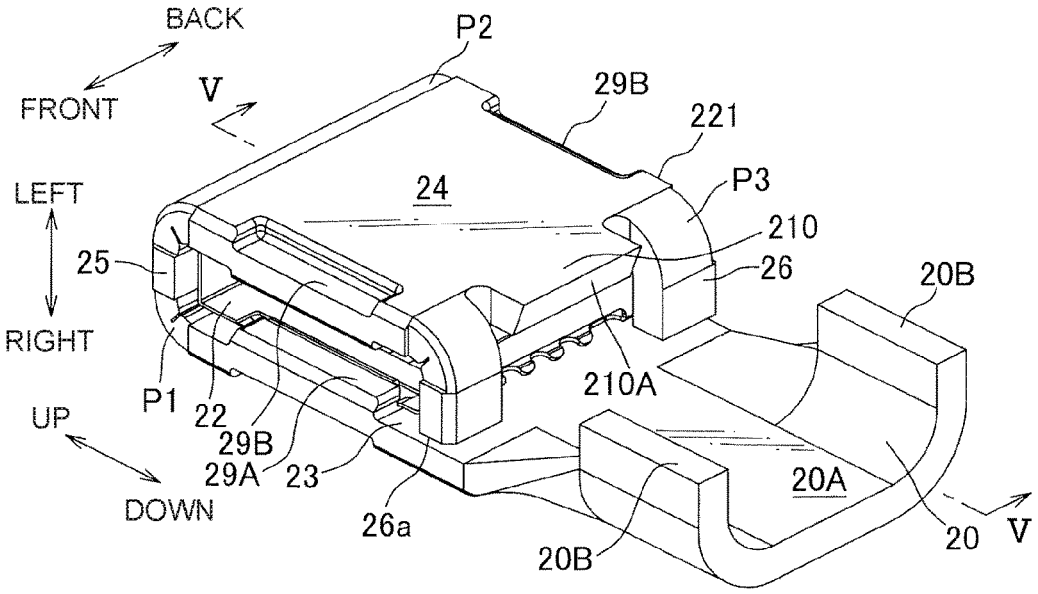
FIG. 10A is a perspective view of another variation of the terminal shown in FIG. 3.
Figure 10B:
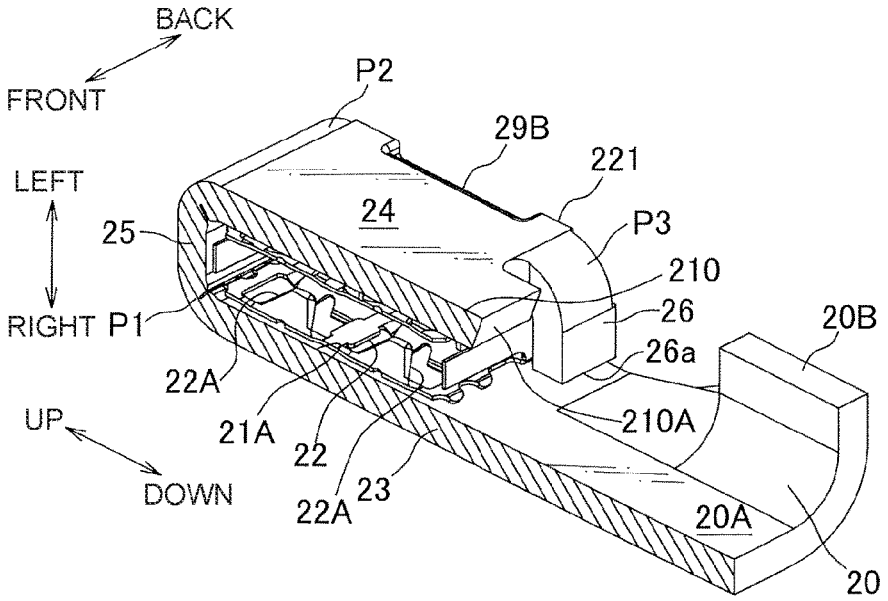
FIG. 10B is a sectional perspective view taken on line V-V of FIG. 10A.
Figure 11:
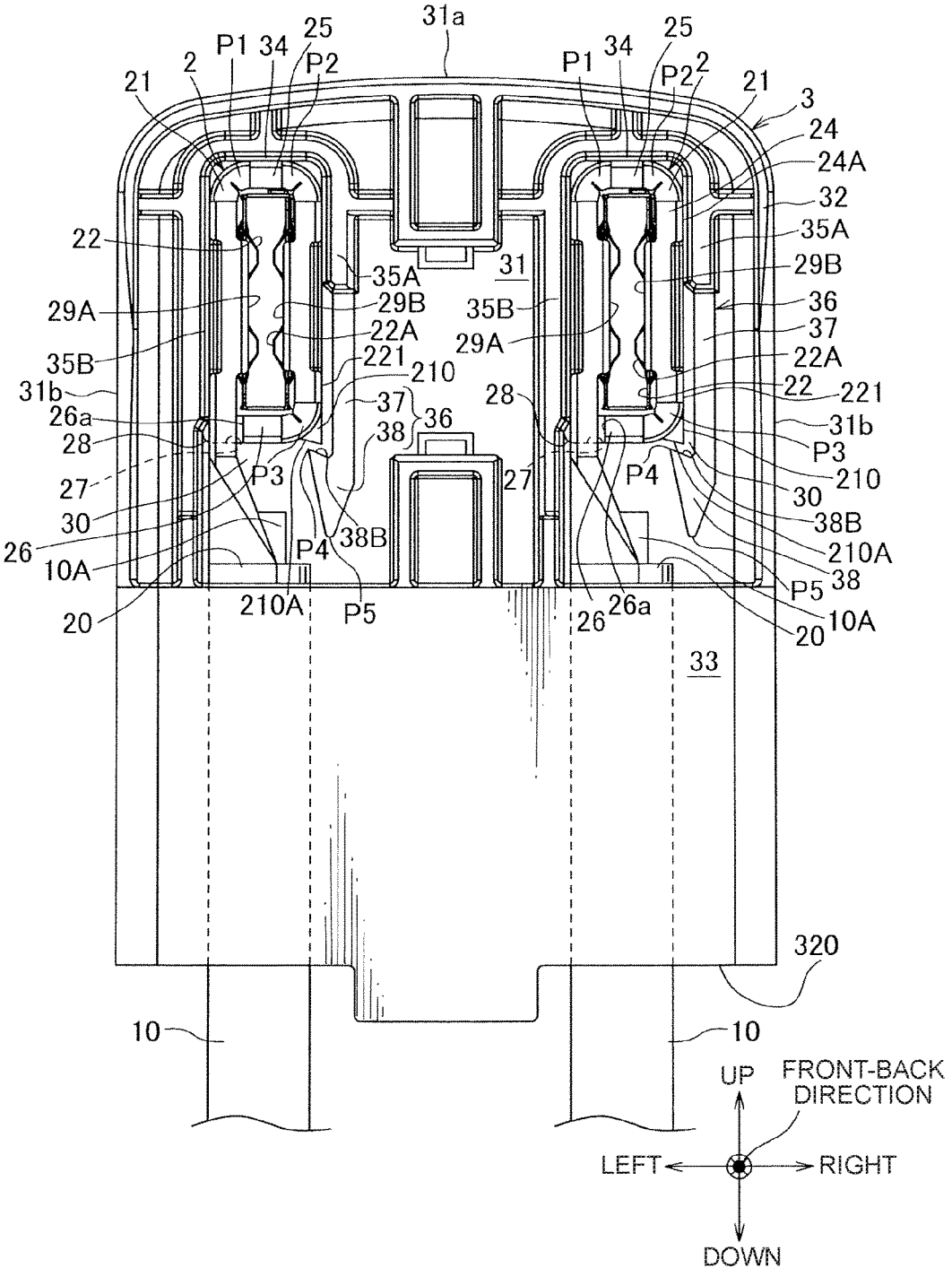
FIG. 11 is a plan view showing a state that the terminal is caught by the locking arm of the inner housing.
Figure 12:
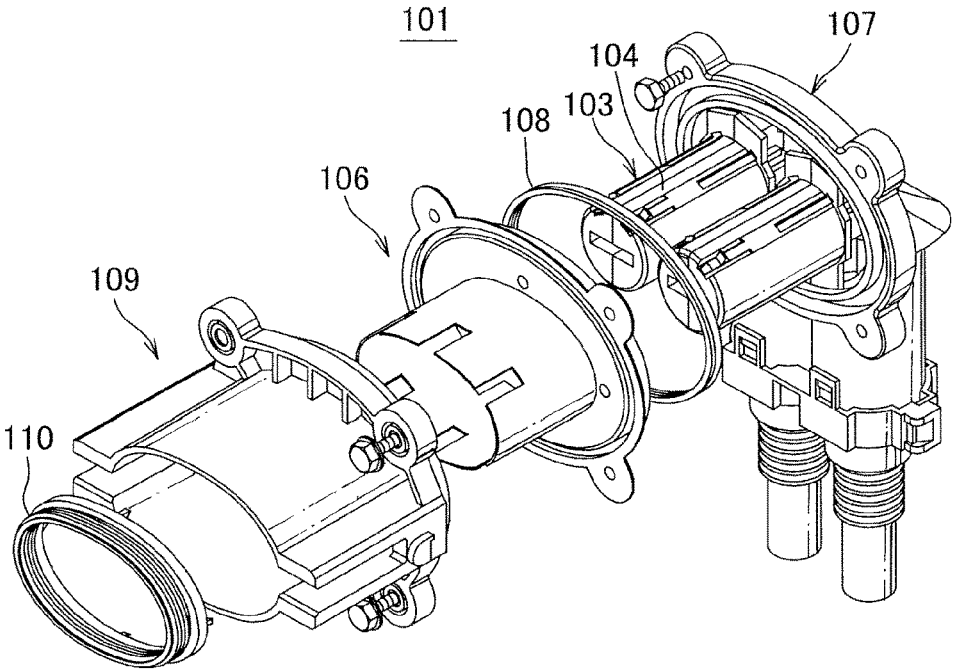
FIG. 12 PRIOR ART
FIG. 12 is an exploded perspective view showing a conventional L-shaped connector.
Figure 13:
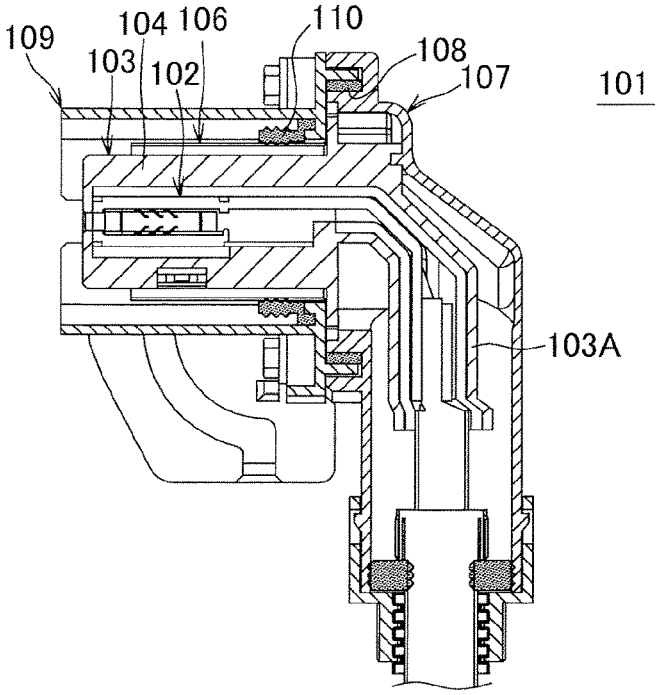
FIG. 13 PRIOR ART
FIG. 13 is a sectional view showing an assembled state of the conventional L-shaped connector.

Further, in the embodiment above, the claw portion 38 of the terminal housing chamber 30 catches the corner portion P3 (border portion) between the second wall portion 24 and the fourth wall portion 26 of the electric contact portion 21. However, the present invention is not limited to this. As shown in FIGS. 10A, 10B, and 11, the electric contact portion 221 may have a hook portion 210 formed by cutting and raising a part of the fourth wall portion 26 toward the claw portion 38. Preferably, a tip end face 210A of the hook portion 210 is an inclined face opposite to the third inclined face 38D of the claw portion 38. According to this, for example, even if the electric wire 10 connected to the female terminal 2 is pulled, the tip end face 210A of the hook portion 210 and the third inclined face 38D of the claw portion 38 abut on each other, and thereby a catch between the hook portion 210 and the claw portion 28 can be hard to be released.

Further, in the previous embodiment, the hook portion is formed by cutting and raising a part of the fourth wall portion 26 toward the claw portion 38. However, the present invention is not limited to this. The hook portion can be in any shape as long as the claw portion 38 can catch. For example, the hook portion may be a convex portion formed on the corner portion (border portion) P3 positioned on the border between the second wall portion 24 and the fourth wall portion 26, or may be a convex portion formed on the corner portion (border portion) P3 positioned on the border between the second wall portion 24 and the fourth wall portion 26.

The best configuration, the best method, and the like for practicing the present invention are disclosed in the above description. However, the present invention is not limited to these. Namely, the present invention is illustrated and described mainly with respect to a specific embodiment, however, the skilled person could modify the detailed configurations such as a shape, material, the number, or the like without departing from the spirit and the scope of the present invention. Therefore, the above-disclosed description specifying the shape, material, or the like is exemplified for facilitating the understanding of the present invention, and not limits the present invention. Therefore, a description releasing a part of, or all of the limitations of a shape, material, or the like is within a scope of the present invention.

REFERENCE SIGNS LIST

1 connector
2 female terminal (terminal)
3 inner housing (housing)
10 shield electric wire
20 wire connection portion
21 electric contact portion
23 first wall portion
24 second wall portion
25 third wall portion
26 fourth wall portion
30 terminal housing chamber (housing chamber)
36 locking arm
38 claw portion
210 hook portion
P3 corner portion (border portion between the second and fourth wall portions)

The invention claimed is:

1. A connector comprising: a terminal to which an electric wire is connected; and a housing having a housing chamber for housing the terminal, wherein the terminal includes a wire connection portion, and an electric contact portion arranged in a row with the wire connection portion and formed in a tubular shape of which inner periphery contacts a mating terminal, wherein an axial direction of the electric contact portion crosses a direction along which the wire connection portion and the electric contact portion are arranged in a row wherein electric contact portion is formed in a tubular shape with a first wall portion continuing to the wire connection portion, a second wall portion facing the first wall portion, a third wall portion interposed between the first and second wall portions, and a fourth wall portion in the wire connection portion side and facing the third wall portion, wherein the housing includes a locking arm composed of an arm portion of which a base end is fixed to an inner face of the housing chamber, said arm portion extending along a direction same as a direction that the third and fourth wall portions face each other, and a claw portion provided on a free end of the arm portion, and wherein the claw portion catches a border portion between the second and the fourth wall portions.

2. The connector as claimed in claim 1, wherein a hook portion to be hooked on the claw portion is formed on the border portion.

3. The connector as claimed in claim 2, wherein the hook portion is cut and raised toward the claw portion.

* * * * *